United States Patent [19]

Wada et al.

[11] Patent Number: 4,975,186

[45] **Date of Patent: * Dec. 4, 1990**

[54] CONTAINER FOR FINE SEPARATION OF BLOOD AND BLOOD COMPONENTS

[75] Inventors: Shohachi Wada, Oakland; Bruce Kuhlemann, Hayward, both of Calif.

[73] Assignee: Miles Laboratories, Inc., Elkhart, Ind.

[ * ] Notice: The portion of the term of this patent subsequent to Aug. 15, 2006 has been disclaimed.

[21] Appl. No.: 802,914

[22] Filed: Nov. 29, 1985

Related U.S. Application Data

[63] Continuation of Ser. No. 585,793, Mar. 2, 1984, Pat. No. 4,857,190.

[51] Int. Cl.[5] ..... B65D 35/22

[52] U.S. Cl. ..... 210/232; 210/534; 604/410

[58] Field of Search ..... 604/410; 206/437, 438; 222/44; 422/41, 44, 49; 210/927, 232, 534; 494/13

[56] References Cited

U.S. PATENT DOCUMENTS 3,911,918 10/1975 Turner ..... 422/41 X 4,857,190 8/1989 Wada et al. ..... 210/232

*Primary Examiner*—Frank Spear

*Attorney, Agent, or Firm*—James A. Giblin

[57] ABSTRACT

Blood and blood component container having in continuous communication therewith a receptacle adapted to receive and define a given component or sub-component when contents in the container are separated. In preferred embodiments, the container is a flexible bag having a tapered portion adjacent the receptacle to assist migration of a given component or sub-component into the receptacle during centrifugation and at least a portion of the container is supported by a cup-like device, the inner surface of which conforms to the outer surface of the bag and communicating receptacle.

2 Claims, 1 Drawing Sheet

CONTAINER FOR FINE SEPARATION OF BLOOD AND BLOOD COMPONENTS

This application is a continuation of application Ser. No. 585,793, filed Mar. 2, 1984, now U.S. Pat. No. 4,857,190.

BACKGROUND OF THE INVENTION

1. Field:

This disclosure is concerned generally with containers for blood and blood components and specifically with a container designed to assure fine separation of various components and sub-components of blood.

2. Prior Art:

It is well known that blood can be separated into various components or sub-components which then can be given to patients deficient in one or more components. Major components of whole blood include red blood cells, white blood cells (leucocytes), blood platelets, and plasma and it is well known that the plasma component can be further separated or fractionated into sub-components having therapeutic uses.

Whole blood is commonly collected into a flexible plastic donor bag having connected to it via tubings one or more satellite bags. In a typical situation, whole blood collected in the donor bag is centrifuged, resulting in a lower layer of packed red blood cells and an upper layer of platelet-rich plasma. The platelet-rich plasma may then be expressed via connecting tubing to a satellite bag which, in turn, can be centrifuged to separate the platelets from the plasma which itself may be further fractionated into useful products by known means (e.g. Cohn fractionation).

A blood bag designed to separate newer red blood cells (neocytes) from older red blood cells (gerocytes) has been disclosed recently in U.S. Pat. No. 4,416,778. The bag comprises two separate chambers connected via a conduit with a valve means between the two chambers. There appears no suggestion that the chambers should be in continuous communication or that that type of apparatus would be useful without the intermediate valving means. There are no suggestions of other blood separating applications, especially applications concerned with the separation and use of platelets.

The platelets contained from a single donation represent only a fraction (usually about one-sixth) of the amount used in a common therapeutic administration. Because of this, it is common practice to express the platelets obtained from several satellite bags into a single platelet pooling bag which holds platelets from about six separate donations. Such pooling bags are then used to administer the platelet concentrate to a patient.

When platelets are separated from platelet-rich plasma, it is known that white blood cells (WBC's) are included in the platelet concentrate. The presence of such cells has been associated with febrile transfusion reactions and alloimmunization reactions. See, for example, an article by J. G. Eernisse and A. Brand, Exp. Hemotol., January 1981, Vol. 9, No. 1, pp. 77–83. Although it is not yet a common practice to take steps to separate the WBC's from a platelet concentrate, in those cases where it is done (less than 10%), the platelets of a standard platelet concentrate bag are simply centrifuged and this results in an upper layer of platelets relatively free of WBC's and a lower layer of WBC's. This separation technique removes about 96% of the contaminating WBC's (but at a 21% platelet loss) according to R. H. Herzig et al, Blood, Vol. 46, No. 5, pp. 743–749 (Nov.) 1975. This is thought to be because the interface between the centrifuged platelets and the WBC's is relatively large and, in the ultimate separation of the platelets from the original container, the relatively large interface, in conjunction with the use of a flexible bag, makes it difficult to obtain a fine separation which assures (1) obtaining maximum amount of platelets, and (2) minimum WBC's in the platelet product. In other words, current techniques make it very difficult to obtain a clean cut between the upper platelets and the lower WBC's which occupy the lower volume of a typical platelet pooling bag.

We have now devised a blood bag which avoids the above problems. Unlike the relatively complicated and costly neocyte preparation bags of U.S. Pat. No. 4,416,778, our bag has a fairly simple design and can be used for a variety of separations involving blood components although it is especially suitable as a platelet pooling bag. Details are described below.

SUMMARY OF THE INVENTION

Our container for the fine separation of blood and blood components comprises a single, flexible plastic bag having in continuous communication therewith an integrally connected receptacle adapted to receive and define a given blood component or sub-component when the contents of the container are separated (e.g. via centrifugation or other methods). In preferred embodiments the container is a flexible bag having a tapered portion adjacent the receptacle to assist migration of a given component or sub-component into the receptacle during the separation process. In further preferred embodiments, and during the separation procedure, at least a portion of the container is supported by a cup-like device, the inner surfaces of which conform to at least a portion of the outer surface of the blood bag and communicating receptacle.

SPECIFIC EMBODIMENTS

Figure 1:
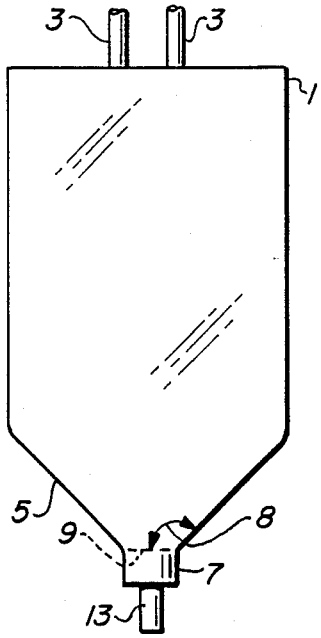
FIG. 1 shows one embodiment of a blood bag of this disclosure.

The container of this disclosure is preferably a flexible bag made from a medical grade (medically acceptable) plastic material such as polyvinyl chloride. The walls of the receptacle are continuous with the walls of the remainder of the bag. Although such bags may be made using conventional blood bag manufacturing techniques, in a preferred embodiment, the bag is made by simply edge-sealing via known methods two opposing plastic sheets adapted to define the majority of the container itself (of a given volume) and the communicating receptacle (of a lesser volume), preferably connected by an intermediate tapered portion (at an angle of about 115° to 155° to the interface) to facilitate the separation process. In the case of a platelet pooling bag, the total volume of the bag is preferably about 400 ml, about 3 ml of which comprises the connecting receptacle. Unlike prior art bags having more than one compartment or chamber (such as U.S. Pat. No. 4,416,778)

the communication between the receptacle and remainder of the container is continuous (i.e. no conduits or tubing separate the receptacle and a valving means is not required to open or close the receptacle during centrifugation. As used herein, the expression continuous communication, as applied to the bags of this disclosure, means that the walls of the receptacle are continuous with the walls of the remainder of the container and that the receptacle interior (and its contents) is at all times during the separation process in communication with the interior of the remainder of the bag.

In use, a platelet pooling bag containing both platelets and the undesired WBC's is centrifuged (e.g. at 1200 rpm or 400 g for 10 min.) to cause sedimentation (migration) of the WBC's into the receptacle where a clean and relatively small area of the platelet/WBC interface forms. Prior to expressing the platelets from the bag after such centrifugation, a clamping means may be positioned slightly above the interface (on platelet side of the interface) to reduce even further the likelihood of WBC migration from the receptacle during platelet removal. Alternatively, the WBC's may be removed via a simple receptacle exit fitting.

The modified bag of this disclosure may be used with conventional centrifugation equipment. It can be appreciated, however, that the unorthodox shape of the bag will not conform to centrifuge cups typically used to centrifuge blood bag contents. Such non-conformity can interfere with the separations contemplated by this disclosure by interfering with or preventing the formation of a platelet/WBC interface at the top of the receptacle due to the flexible nature of a plastic blood bag. The flexibility of the bag might cause the receptacle portion of the bag to fold under the remainder of the bag because of centrifugal forces or even gravity. This can readily be avoided, if necessary, by providing a centrifuge cup insert, the inner surface of which conforms generally to the outer surface of at least the lower portion (having the receptacle) of the bag being centrifuged. Such inserts should be made of any rigid and durable material (e.g. structural foams such as polyurethane, polyolefins, polystyrene, etc.) which will support at least the lower portion (preferably all or most of the total bag) during centrifugation. The outer surface of such supports is not as important as the inner surface, it being sufficient that the outer geometry allow mere insertion into the centrifuge cup. In an ideal situation, however, the outer portion of the supporting insert will conform generally to the inner surface of the centrifuge cup to assure a snug and upright fit. While the bags of this disclosure would be disposable, the inserts used to support the bag need not be.

The bags of this disclosure may be better appreciated by reference to the figures and the following details and data. FIG. 1 illustrates a blood or blood component bag 1 embodying the principles of this disclosure. As can be seen, bag 1 includes exit/entry ports 3 (the number of which may vary) for introducing or removing bag contents. Although the upper part of the bag shown has essentially parallel sides, the lower portion 5 of the bag 1 tapers at an oblique angle 8 of about 135° with imaginary interface area 9 as it approaches receptacle 7 (see arrows 8 of FIG. 1). The receptacle communicates with and is continuous with the tapered portion 5. Attached to and continuous with receptacle 7 is an optional drainage port 13 which is typically closed during centrifugation but which may be opened after centrifugation to remove products which have collected in receptacle 7 as a consequence of centrifugation, thus making it even easier to assure a fine separation of the upper contents in the receptacle. The interface 9 between the receptacle contents 7 and the contents of the remainder of the bag (upper portion, including the tapered portion) is preferably kept as small as possible to assure a fine separation. In the case of a platelet pooling bag the preferred interface separating the receptacle 7 volume of about 3 ml and the upper contents volume of about 400 ml is about 5 $cm^2$. As noted above, the bag may be adapted to accept an external clamp at about the interface 9 position to minimize mingling of separated contents at the interface during the expressing, pouring off, or administration of the upper contents. A strong hemostat clamp may be used and other clamps will be apparent to those skilled in the art.

Figure 2:
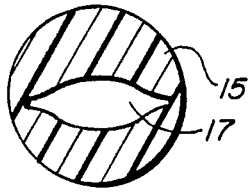
FIGS. 2, 2*a* and 2*b* are cross sections of a cup-like device into which the bag of FIG. 1 can be inserted for the centrifugation process.
Figure 2A:
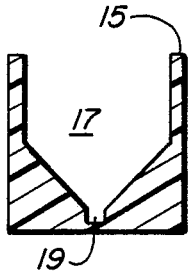
Figure 2B:
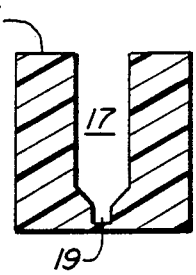

Various centrifuge cup inserts adapted to support the bags during centrifugation (and before and afterward also) are shown in cross section in the remaining Figures. FIG. 2 illustrates an insert 15 viewed in cross section about half way from the top and showing an interior 17 which conforms generally to the exterior of a bag such as that shown in FIG. 1. FIG. 2*a* shows a cross section of the entire insert 15 showing a receptacle receiving/supporting cavity 19 and bag cavity 17 which conforms to the widest dimension of a typical bag. FIG. 2*b* shows the cavity 17 as adapted to support the narrower portion (dimension) of the same bag.

Figure 3:
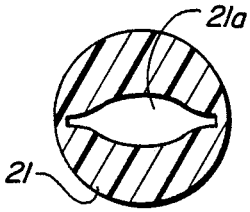
FIGS. 3, 3*a* and 3*b* and FIGS. 4, 4*a* and 4*b* are cross sections of other cup-like supports that may be employed in practicing the teachings of this disclosure.
Figure 3A:
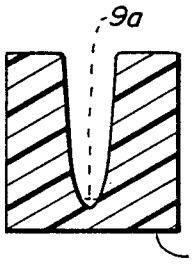
Figure 3B:
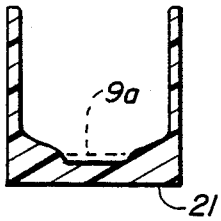

FIGS. 3, 3*a* and 3*b* show similar cross sections of yet further embodiments of inserts 21 having major cavities 21*a* and receptacle supporting cavities adapted to assure a relatively small separation interface at 9*a*.

Figure 4:
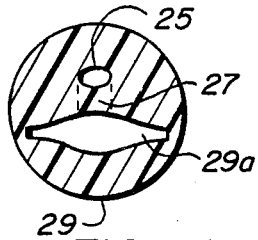
Figure 4A:
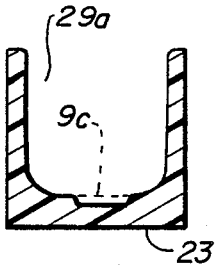
Figure 4B:
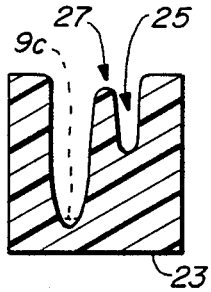

FIGS. 4, 4*a* and 4*b* show yet further cross sections of insert embodiments contemplated to support bags and attached connecting tubing to keep the tubing such as tubing 3 out of cavity 29*a*. As can be seen in FIG. 4, insert 29 includes a larger cavity 29*a*, a cavity 25 for holding tubing 3 away from cavity 29*a* and a connecting channel 27 for placement of the tubing 3.

In a typical working example, a platelet pooling bag such as that shown as 1 in FIG. 1 is made from a flexible, plasticized PVC material using conventional PVC bag forming techniques. In a preferred embodiment, the bag would comprise a plastic especially suitable for platelet storage such as the TOTM-plasticized PVC of U.S. Pat. No. 4,280,497. The total bag volume is about 400 ml and the receptacle volume is about 3 ml. Tapered portion 5 comprises about a 70 ml volume and interface 9 is about 5 $cm^2$. The supporting inserts (FIGS. 2, 3 or 4) are made of polyurethane and support about 80% of the total bag outer surfaces.

In a typical centrifugation (IEC model no. PR-6000, at 900 rpm—221 g—for 10 min.), the following data were obtained from platelet/WBC separations using the bag of this disclosure.

TABLE 1

Fine Separation of Platelets from WBC's vs. Conventional Separations (using standard bags)*

| Trial # | # Units pooled | Volume (ml) | Yield of Platelet (%) | Platelet per unit $\times 10^{-10}$ | Leukocyte removal (%) | Leukocyte per unit $\times 10^{-7}$ |
|---|---|---|---|---|---|---|
| 1 | 6 | 345 | 94.4 | 6.46 | 93.3 | 0.32 |
| 2 | 6 | 341 | 89.3 | 6.43 | 82.4 | 1.61 |
| 3 | 6 | 347 | 93.5 | 6.71 | 84.3 | 2.15 |
| 4 | 7 | 360 | 94.5 | 6.18 | 77.4 | 2.61 |
| 5 | 6 | 345 | 94.8 | 5.78 | 81.5 | 0.6 |
| 6 | 6 | 343 | 97.3 | 6.09 | 81.1 | 1.1 |

TABLE 1-continued

Fine Separation of Platelets from WBC's vs. Conventional Separations (using standard bags)*

| Trial # | # Units pooled | Volume (ml) | Yield of Platelet (%) | Platelet per unit $\times 10^{-10}$ | Leukocyte removal (%) | Leukocyte per unit $\times 10^{-7}$ |
|---|---|---|---|---|---|---|
| 7 | 5 | 286 | 95.3 | 6.54 | 84.2 | 2.3 |
| 8 | 6 | 350 | 97.4 | 7.64 | 89.6 | 0.82 |
| 9 | 6 | 340 | 95.3 | 5.98 | — | — |
| 10 | 6 | 350 | 94.9 | 5.37 | 89.6 | 0.39 |
| Average vs. | | | 94.6 | | 84.8 | |
| Conventional Separation | | | ~75.0 | | ~80.0 | |

Note:
(1) WBS removal may be increased at sacrifice of platelet yield by changing centrifugation conditions (see C. A. Schiffer et al, Blood, Vol. 62, No. 4, (Oct.), pp. 815–820 at p. 816 (1983).
(2) Centrifugation was at 900 rpm (221 g) for 10 min.
*Ordinary commercial flat bottom pooling bag with no tapering or receptacle.

Given this disclosure, it is thought that numerous variations will occur to those skilled in the art. Accordingly, it is intended that the above examples should be considered merely illustrative and that the scope of the invention disclosed herein should be limited only by the following claims.

We claim:

1. A platelet pooling bag having in continuous communication therewith a receptacle adapted to receive and define a given volume of white blood cells when a mixture of platelets and white blood cells in the bag are separated, the receptacle having two end portions, an open receiving end in continuous communication with the container and an opposite closed end adapted to assist in containing the white blood cells, the volume of the receptacle comprising about 0.75% of the total volume of the bag, the bag including receptacle support means adapted to conform generally to the external dimensions of the bag and receptacle and help maintain said dimensions when the bag is subjected to centrifugal forces.

2. The bag of claim 1 wherein the support means is adapted to receive a component withdrawal means in communication with the receptacle.

* * * * *